United States Patent [19]

Beusen

[11] 4,190,035

[45] Feb. 26, 1980

[54] FLUID HEATER

[76] Inventor: Gerardus L. Beusen, v. Twillerstraat 25, Nijkerk, Netherlands

[21] Appl. No.: 845,054

[22] Filed: Oct. 25, 1977

[30] Foreign Application Priority Data

Oct. 28, 1976 [DE] Fed. Rep. of Germany ..... 2649174

[51] Int. Cl.[2] ..... F24H 3/06

[52] U.S. Cl. ..... 126/99 A; 126/99 C; 126/116 R; 126/102

[58] Field of Search ..... 126/99 A, 99 C, 104 R, 126/102, 110 B, 110 R, 116 R

[56] References Cited

U.S. PATENT DOCUMENTS

| | | | |
|---|---|---|---|
| 1,357,598 | 11/1920 | Thompson | 126/110 B |
| 1,972,549 | 9/1934 | Cameron | 126/110 B |
| 2,240,161 | 4/1941 | Mueller | 126/116 R |
| 2,363,742 | 11/1944 | Norton | 126/116 R |
| 3,151,673 | 10/1964 | Strache | 126/116 R |

FOREIGN PATENT DOCUMENTS 2114192 10/1972 Fed. Rep. of Germany .

*Primary Examiner*—Larry I. Schwartz
*Attorney, Agent, or Firm*—Fleit & Jacobson

[57] ABSTRACT

A heating boiler having a combustion chamber, a chimney and preferably curved channels connecting the chamber to the chimney. The combustion chamber is preferably of good aerodynamic shape on the outside and located next to the chimney. The channels preferably join the chimney tangentially, and means are provided for blowing a fluid over the entire heating surface of the chamber and the chimney.

10 Claims, 6 Drawing Figures

FLUID HEATER

This invention relates to a heating boiler having a combustion chamber in which fuel can be ignited and combusted, a chimney, and preferably curved channels for leading the flue gases direct into said chimney.

Such a heating boiler is known from German patent application No. 2,114,192.

The construction shown in FIG. 2 of this publication shows a major change relative to prior boilers, one example of which is illustrated in FIG. 1.

The various advantages are clearly shown by means of several constructions described in said publication. Yet, this manner of construction still leaves some problems. In the construction shown in FIG. 3 of the patent application, it is difficult to clean the flue gas header 16. In addition, the outer shell 18 does not contribute to the heat transfer. Finally, part of the combustion chamber (FIG. 2) suffers from the same drawback.

Although with the prior construction a considerable thermal efficiency was achieved, it is recommendable that this efficiency be further improved, as the constructions described still have relatively large surface area which hardly play a role in the heat transfer.

This fact is going to be important, as public bodies and professional institutions are at present considering an increase in the maximum value of thermal efficiency, which at the present is set at 92% against the lowest calorific value.

Owing to the ever increasing cost of fuel, too, there is a need for a heating boiler which has the advantage of the prior construction, but no longer suffers from the above disadvantages.

It is an object of the present invention to provide such a heating boiler.

According to the present invention, there is provided a heating boiler comprising a combustion chamber in which fuel can be ignited and burnt, a chimney, and preferably curved channels for conducting the combustion gases direct into said chimney, characterized in that the combustion chamber, which is preferably of good aerodynamic shape on the outside as well, and the chimney are located next to one another and interconneced by flues preferably tangentially joining the chimney, and that means are provided for blowing a fluid over at least substantially the entire heating surface of said combustion chamber and said chimney.

In a suitable embodiment of the heating boiler according to the present invention, additional heat is withdrawn from the flue gases by means of relatively cold return air, which is passed over the surface of the chimney, the flue gases being cooled down to the dew point, it being possible for the condensate to be discharged at the bottom of the chimney.

Preferably, the combustion chamber, the chimney and the flues are designed so that the position of these component parts can be turned from the vertical position through 90°, so that in the extreme case horizontal cylinders are formed, without the operation of the apparatus being adversely affected and without fundamental changes in the manufacturing process being necessary.

Furthermore, in the heating boiler according to the invention, the arrangement of the interior of the casing can be modified—without any change in parts important for the manufacture—to provide for the chimney to give off its heat solely to a first fluid, or to a first and a second fluid together, or solely to a second fluid, whereby a greater or smaller amount of heat from the chimney is utilized, and at all times as much as corresponds to the maximum efficiencies allowed by government institutions or official authorities.

In the heating boiler according to the invention, preferably at least one additional passage is offered to the combustion gases, and that above the level of the combustion chamber and tangentially from the chimney by means of preferably curved pipes, which can be dimensioned similarly to the other pipes, thereby returning to an extension of the combustion chamber, the combustion chamber and the extension being separated by a wall.

Some embodiments of the invention will now be described, by way of example, with reference to the accompanying drawings, in which FIG. 1 is a part-sectional side elevation of one embodiment of a heating boiler according to the present invention;

Figure 1:
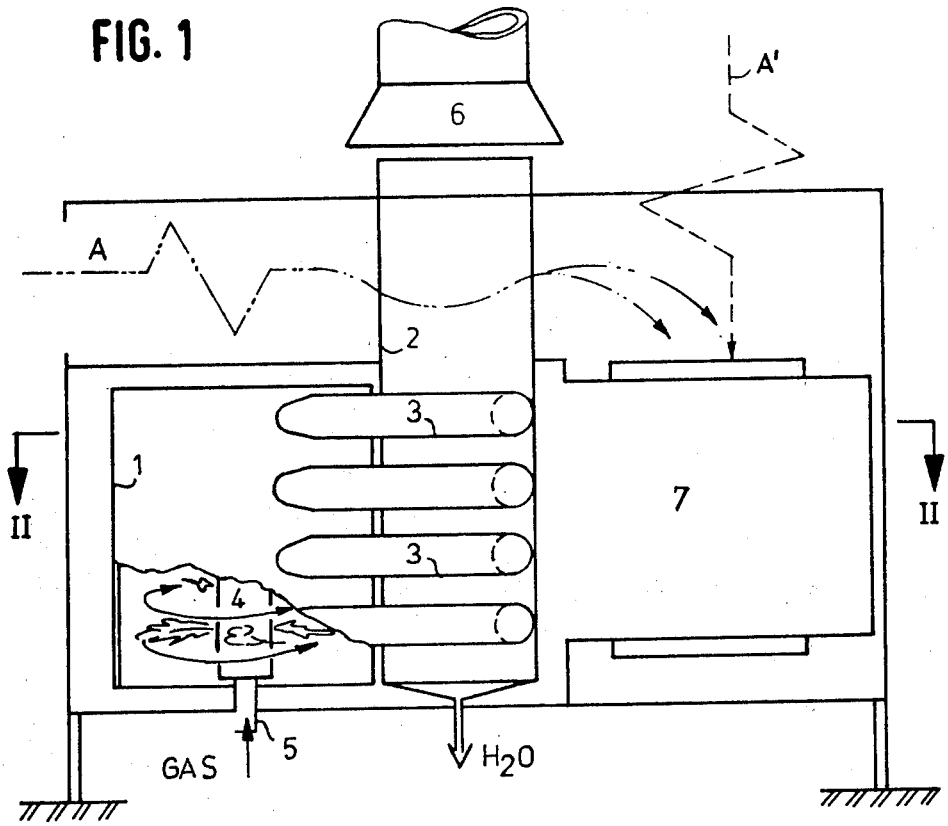
Figure 2:
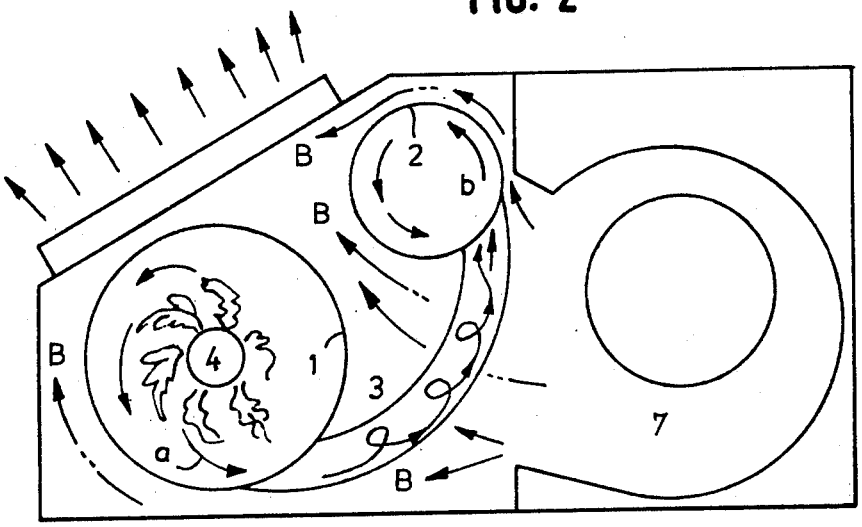
FIG. 2 illustrates a cross-sectional view on the line II—II of FIG. 1.

In the heating boiler shown in FIGS. 1 and 2, the entire combustion chamber 1 is disposed in the current of air in such a manner that it fully participates in the heat transfer, and is connected direct to the chimney by means of pipes (flues) or otherwise.

The burner(s) is (are) mounted axially in a vertical, preferably aerodynamically shaped combustion chamber 1, the outer surface of which chamber fully contribute to the heat transmission. The combustion chamber 1 is connected to the chimney by pipes or the like. The connection between the pipes and the chimney should, as far as practicable, join the circumference of the chimney tangentially. The pipes are preferably curved, leading to an increased heat transmission coefficient on the inside, and at the same time easing expansion of the construction. In this way an ideal expansion bend is provided within the apparatus.

With this fundamentally changed design and arrangement, all advantages inherent in the apparatus described in German patent application No. 2,114,192 are preserved, whereas the disadvantages inherent therein do not occur.

Furthermore, unexpected further possibilities arise for improving the thermal efficiency. The inducing "injection" into chimney 2—as described in German patent application 2,114,192—takes place in a much more direct way in the construction shown in FIGS. 1 and 2.

A consideration of FIGS. 1 and 2 could perhaps lead to the conclusion that the temperature of the flue gases will be higher than without the principle of injection, and that consequently the thermal efficiency will be lower. The adverse effects of the "injection", however, are amply compensated by the fact that both the combustion chamber 1 and chimney 2 are directly and fully involved in the heat transmission. In addition, this method offers effective possibilities of keeping chimney-draught at a sufficiently high and at the same time a minimum level.

Moreover, heat transfer is intensified by the cyclone-shaped whirls within pipes 3 and within the chimney. These currents leads to a greatly increased internal heat transfer coefficient without the necessity of adding additional parts for artificially producing whirls (as is the case in many known appliances). These additionally required parts, however, always result in extra pressure losses in the appliances, something which is always a hampering factor to the designer of appliances for atmospheric burning as regards safe gas engineering. In addition, the parts that have hitherto been additionally required involve problems in cleaning the appliances.

In the construction according to the present invention, cleaning the flue-pipes or chimney presents no problem. An unexpected particular advantage presents itself when the chimney is even more involved in the heat transmission, and that when return air or fresh air (A, FIG. 1) is passed to the fan 7 via the space above the apparatus and along the chimney 2.

The cyclone-shaped current within the chimney leads to an extremely effective heat transfer.

When, in the future, the limit of the maximum permissible efficiency is internationally increased, which limit is connected with preventing the formation of condensation in an unduly cooled chimney, the heating boiler according to the present invention provides a simple possibility of fully discharging such condensate—with utilization of the released heat of condensation—as indicated in FIG. 1, where the draining of condensate is designated by $H_2O$.

Figure 6:
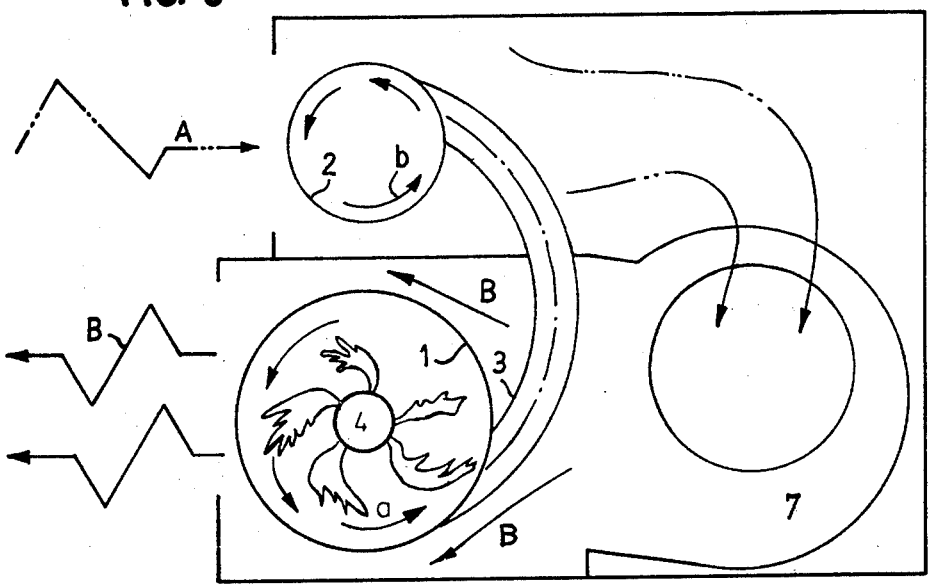
FIG. 6 shows a cross-sectional view of a boiler of the type illustrated in FIG. 5.

By means of a simple adaptation of the housing (FIG. 6), it is further possible, without changing the basic construction, to situate the entire chimney 2 in the relatively cooler current of the intake fluid A, instead of placing the lower part of the chimney in the current of the partly warmer medium B, as is the case in the boiler of FIGS. 1 and 2.

Figure 5:
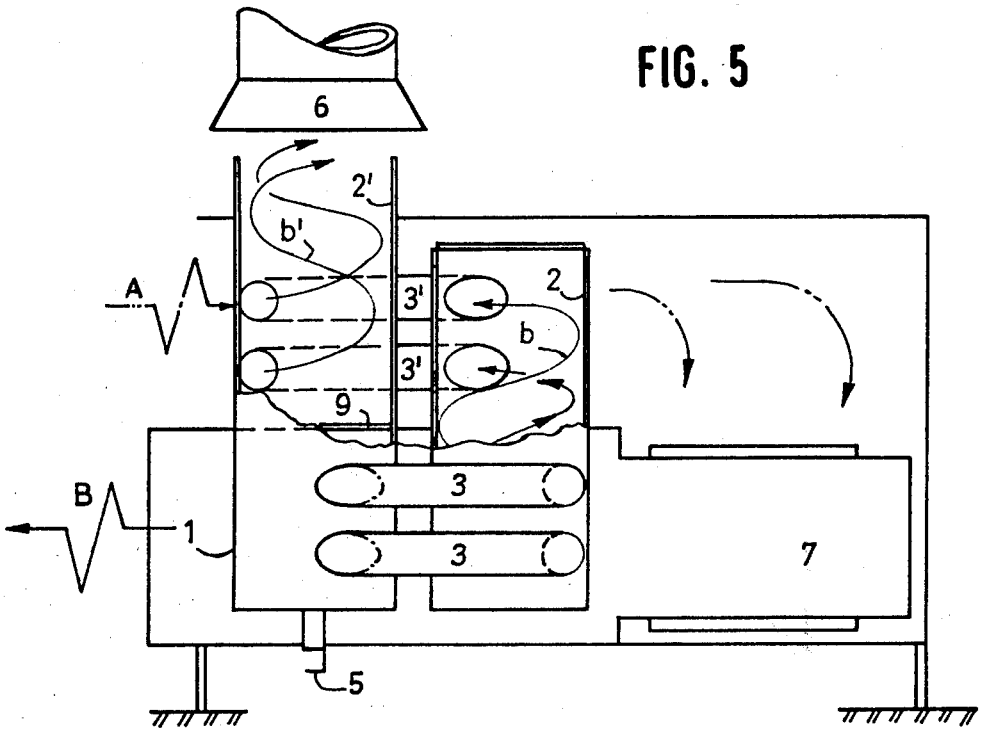
FIG. 5 shows still another embodiment of the heating boiler according to the present invention.

FIG. 5 shows a construction in which the triple connection of combustion chamber 1, pipes (or the like) 3 and chimney 2 is repeated at a level above the combustion chamber, whereby it is possible to pass pipes 3' which tangentially join the chimney 2, to the extension 2' of the combustion chamber 1, with parts 1 and 2' being separated by means of a wall. By so doing a design is possible which, judged by present standards, extracts disproportionate heat quantities from the flue gases without requiring additional investments for the manufacture, such as for stencils, matrices or rolls. The tools required for the first passage of part 1, through part 3 to part 2 are identical to those required for the second, higher passage formed by parts 2, via 3' to part 2'.

As the construction can now be dimensioned for optimum results, it is possible to extract exactly so much heat from the combustion products as the respective national or international regulations allow for. Thus new horizons are opened up, for example, for hothouses and the like, where fuel costs, as a major cost item, represent an ever increasing burden.

Figure 3:
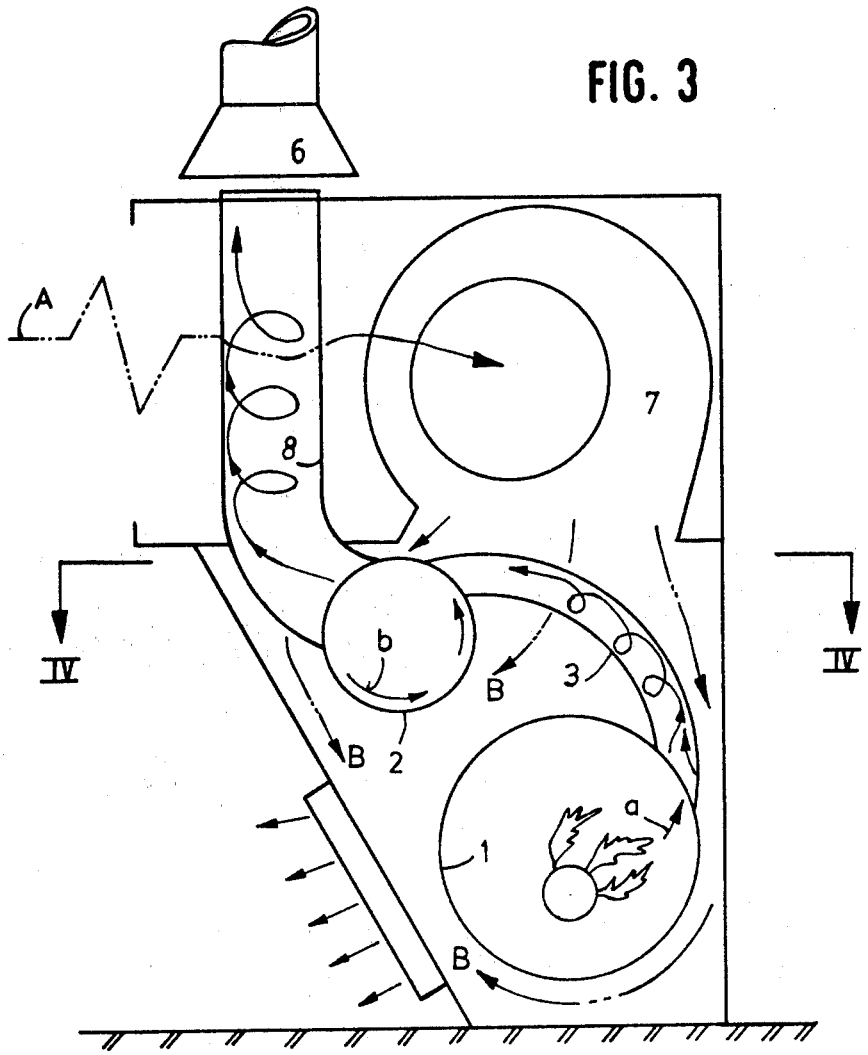
FIG. 3 shows a different embodiment of the heating boiler according to the invention.
Figure 4:
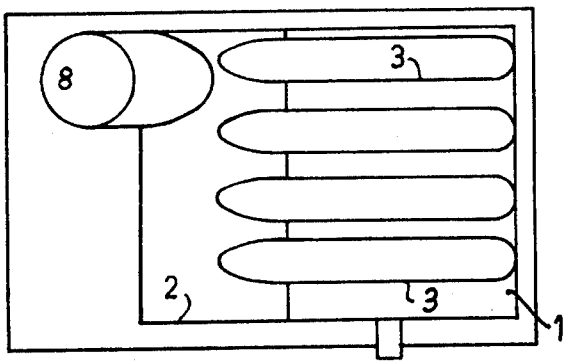
FIG. 4 illustrates a cross-sectional view, taken on the line IV—IV of FIG. 3.

The construction according to the present invention is extremely suitable for variations in fan connections as well as in the arrangement of the basic parts. Thus the entire apparatus can be turned from the vertical position shown in FIG. 1 through 90° , so that in the extreme case the cylinders come to lie horizontally, as shown in FIG. 3. A simple modification of the chimney connection, together with the then-improved injection from one of the pipes 3 into the chimney connection, produces a variant which, as far as the production process is concerned, amounts to a minor alteration only. In this connection reference is made to FIG. 3 and to the cross-sectional view along the lines IV—IV thereof in FIG. 4. In this case, too, the extended chimney 8 can play its part in the total heat transmission, the more so if it is considered that this part is situated within the fan compartment.

An important feature is that the design of the combustion chamber and the connections with the chimney can be made to suit not only aerodynamic requirements but also foundry technology, resulting in an apparatus that can be mass-produced cheaply. This possibility of casting is not provided by the construction according to German patent application No. 2,114,192.

It will be clear that, although the construction is seemingly based on a peculiar design, there are no appreciable pressure losses at the flue-gas end. This makes the construction extremely suitable for atmospheric burning. Naturally it is then certainly suitable for the use of fan burners.

I claim:

1. A device for heating fluids comprising:

a housing;

a combustion chamber positioned within said housing having means for igniting and burning fuel;

a chimney positioned within said housing for removing combustion products from said combustion chamber;

substantially curved channels positioned within said housing for interconnecting said combustion chamber and said chimney in such manner that combustion products are conveyed directly from said combustion chamber to said chimney, said combustion chamber and said chimney being located next to each other with all of said channels being substantially tangential to said chimney, said combustion chamber and chimney having exterior heating surfaces positioned inside said housing; and means for moving a fluid over substantially the entire heating surfaces of said combustion chamber and said chimney.

2. A device according to claim 1 wherein said chimney and said combustion chamber are positioned within said housing in such manner that said means for moving draws unheated fluid over said chimney and blows the drawn fluid over said combustion chamber, the combustion products including flue gases that are cooled and condensed by the drawn fluid, said chimney including means for removing condensed gas from a lower portion of said chimney.

3. A device according to claim 1 wherein said housing, said combustion chamber and said chimney have longitudinal axes and are positionable in such manner that their longitudinal axes form a predetermined angle with respect to a surface supporting the device, the predetermined angle being equal to or greater than 0° and equal to or less than 90°.

4. A device according to claim 2 wherein said housing, said combustion chamber and said chimney have longitudinal axes and are positionable in such manner that their longitudinal axes form a predetermined angle with respect to a surface supporting the device, the predetermined angle being equal to or greater than 0° and equal to or less than 90° .

5. A device according to claim 1 wherein said chimney is positioned in said housing in such manner that substantially all of the fluid moving through said device sequentially passes around said chimney, through said means for moving, and around said combustion chamber.

6. A device according to claim 1 wherein said chimney is positioned in said housing in such manner that part of the fluid moving over said chimney is drawn over said chimney by said means for moving and part of the fluid moving over said chimney is blown over said chimney by said means for moving.

7. A device according to claim 1 wherein said chimney is positioned in said housing in such manner that substantially all of the fluid moving over said chimney is blown over said chimney by said means for moving.

8. A device according to claim 1 wherein said combustion chamber has an external surface designed to facilitiate fluid flow past the external surface.

9. A device for heating fluids comprising:

a housing a combustion chamber positioned within said housing having an axis and means for igniting and burning fuel;

a chimney positioned within said housing for removing combustion products from said combustion chamber, said chimney having a first component positioned with its axis parallel to and spaced from the axis of said combustion chamber and a second component positioned with its axis coaxial with the axis of said combustion chamber; and a first set of substantially curved channels positioned within said housing for interconnecting said combustion chamber and said first component of said chimney in such manner that combustion products are conveyed directly from said combustion chamber to said first component of said chimney;

a second set of substantially curved channels positioned within said housing for interconnecting said first and said second components of said chimney, said first and said second sets of channels being substantially tangential to said first and second components of said chimney, respectively, said combustion chamber and said chimney having exterior heating surfaces; and means for moving a fluid over substantially the entire heating surfaces of said combustion chamber and said chimney.

10. A device according to claim 9 wherein said first and said second sets of channels are interchangeable.

* * * * *